US005997409A

United States Patent [19]

Mattson

[11] Patent Number: 5,997,409

[45] Date of Patent: Dec. 7, 1999

[54] UNIVERSAL GOLF CLUB

[76] Inventor: Herbert L. Mattson, 6180 Secluded Lake Ct., Rockford, Mich. 49341

[21] Appl. No.: 09/115,312

[22] Filed: Jul. 14, 1998

Related U.S. Application Data

[60] Provisional application No. 60/074,647, Feb. 13, 1998.

[51] Int. Cl.[6] ..... A63B 53/02; A63B 53/04

[52] U.S. Cl. ..... 473/244; 473/246; 473/252; 473/307; 473/313

[58] Field of Search ..... 473/305–315, 473/244, 245, 246, 247, 248, 250, 251, 255, 340, 313, 341, 288, 219, 231, 223, 252; 403/83, 84, 85, 90, 91, 141, 142, 143

[56] References Cited

U.S. PATENT DOCUMENTS

| | | |
|---|---|---|
| 179,246 | 11/1876 | Gillon . |
| 180,257 | 5/1876 | Wetzel . |
| 205,527 | 8/1878 | Andis . |
| 209,760 | 1/1878 | Andis . |
| 1,352,020 | 9/1920 | Olson . |
| 2,708,579 | 5/1955 | Hugman . |
| 4,735,414 | 4/1988 | Williams . |
| 4,881,737 | 11/1989 | Mullins . |
| 5,253,869 | 10/1993 | Dingle . |
| 5,320,346 | 6/1994 | Phillips . |
| 5,340,104 | 8/1994 | Griffin . |
| 5,348,295 | 9/1994 | Phillips . |
| 5,390,918 | 2/1995 | Meyers et al. . |
| 5,390,919 | 2/1995 | Stubbs . |
| 5,407,196 | 4/1995 | Busnardo . |
| 5,415,399 | 5/1995 | Kettleson . |
| 5,429,356 | 7/1995 | Dingle et al. . |
| 5,462,279 | 10/1995 | Culpepper . |
| 5,470,063 | 11/1995 | Fisher . |
| 5,531,445 | 7/1996 | Levocz et al. . |
| 5,542,665 | 8/1996 | Levocz et al. . |
| 5,577,726 | 11/1996 | Fenton . |
| 5,580,051 | 12/1996 | Fisher . |
| 5,597,362 | 1/1997 | Lee et al. . |
| 5,603,666 | 2/1997 | Bowe . |
| 5,692,969 | 12/1997 | Schooler . |
| 5,709,613 | 1/1998 | Sheraw . |

OTHER PUBLICATIONS

The GIMME High–Tech Putter by Tru–Line USA, 1999 [retrieved on 1999–06–29]. Retrieved from the Internet: <URL: http:\\www.thegimme.com\index.htm.

*Primary Examiner*—Sebastiano Passaniti
*Attorney, Agent, or Firm*—Miller, Johnson, Snell & Commiskey, P.L.C.; Barry C. Kane

[57] ABSTRACT

A golf club wherein the lie angle of the shaft with respect to the head may be adjusted such that the sole, toe and heel of the club may be parallel to the ground and configured for use by both left-handed and right-handed players. The attachment of the golf club head to the shaft also permits adjustment of the golf club head to either the open, standard, or closed configuration to compensate for a player's swing.

18 Claims, 2 Drawing Sheets

UNIVERSAL GOLF CLUB

This application claims priority to U.S. Provisional Patent Application Serial No. 60/074,647; filed Feb. 13, 1998.

BACKGROUND OF THE INVENTION

1. Field of the Invention

This invention relates to the game of golf and particularly to a unique golf club construction which may be used by left- and right-handed players wherein the club head can be adjusted to a variety of club head pitch and lie orientations to suit a particular player's needs.

2. Discussion of the Related Art

Traditionally in the game of golf, clubs were designed either for a left-handed or right-handed player wherein the pitch of the playing face and the lie angle of the head was preconfigured and fixed with respect to the axis of the shaft. Similarly, the face of the club was also preconfigured to be a standard face or may be fixed in either an open or closed ("hooded") configuration to compensate for a player's swing. As a result, a set of clubs is expected to be suitable for substantially every playing condition. Accordingly, in certain situations the sole of the club is sometime not entirely parallel to the ground or does not compensate for particular swing habits. In such instances, the club face does not fully address the ball and may result in an errant shot.

It is the purpose of this invention to provide a golf club wherein the lie angle of the shaft with respect to the head may be adjusted such that the sole, toe and heel of the club may be parallel to the ground. The attachment method of the club head to the shaft also permits adjustment of the shaft for left- or right-handed players and can also be adjusted to adjust for open or closed angles of the head.

SUMMARY OF THE INVENTION

The golf club embodying the instant invention may be a driver, iron, or putter, and includes a club head coupled to the shaft by a universal joint which may be rigidly fixed in position to a player's desired configuration. The universal joint is formed by a ball and socket arrangement wherein the ball is attached to the end of the golf club shaft and captured in the golf club head by a clamping arrangement. A spherical ball/socket arrangement permits adjustment of the shaft with respect to the head to accommodate both left- and right-handed players. Additionally, the head may be rotated about the longitudinal axis of the shaft and the attached grip to create an open or closed configuration of the club face. The angular orientation of the club face or loft of the club may also be adjusted by pivoting the club head by its transverse axis passing through the ball/socket arrangement.

The advantages provided by such an arrangement permit substantially greater flexibility than previously achieved in standard golf club constructions. Additionally, the angular orientation of the shaft with respect to the club head can be quickly changed on the golf course. Previously, such adjustments were required to be made at a golf pro shop and often took weeks to complete. These and other advantages will become apparent to the those skilled in the art upon reading of the specification and in reference to the attached drawing figures.

BRIEF DESCRIPTION OF THE DRAWING FIGURES

DETAILED DESCRIPTION OF THE VARIOUS EMBODIMENTS

Figure 1:
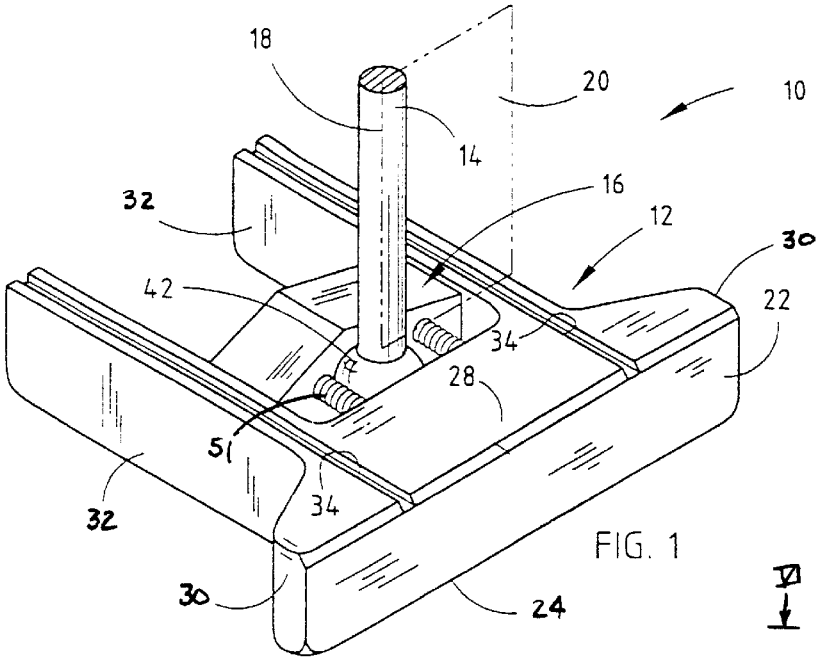
FIG. 1 is an oblique view of the golf club embodying the invention.
Figure 6:
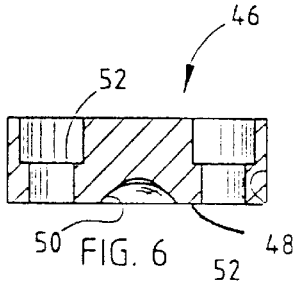
FIG. 6 is a section view of the clamping member shown in FIG. 5 taken along Line VI—VI.
Figure 5:
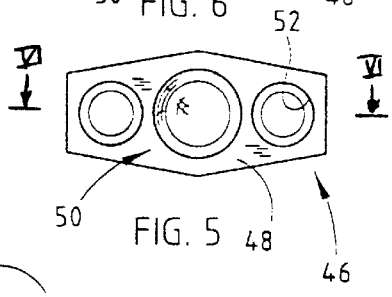
FIG. 5 is a front elevational view of the clamping member.

FIGS. 1–6 illustrate the various views of one embodiment of a golf club head embodying the invention. Although the following description will be made with reference to a specific golf club head configuration, it is contemplated that the invention can be applied equally as well to other head designs. Referring to the drawing figures, the golf club 10 includes a golf club head 12 coupled to a golf club shaft 14 by a pivoting universal coupler 16 in the form of a ball and socket arrangement. Although the upper portion of the shaft 14 is not shown, the shaft may include a conventional grip having any one of a number of different shapes or reference point to assist the golfer in achieving the proper grip of the club. In this particular instance, the shaft defines a line 18 defined by a plane 20 passing longitudinally through the shaft 14. The golf club head 12 may have any one of a number of configurations depending upon the desired application, such as a driver, an iron, or the putter configuration shown in the drawing figures.

Figure 2:
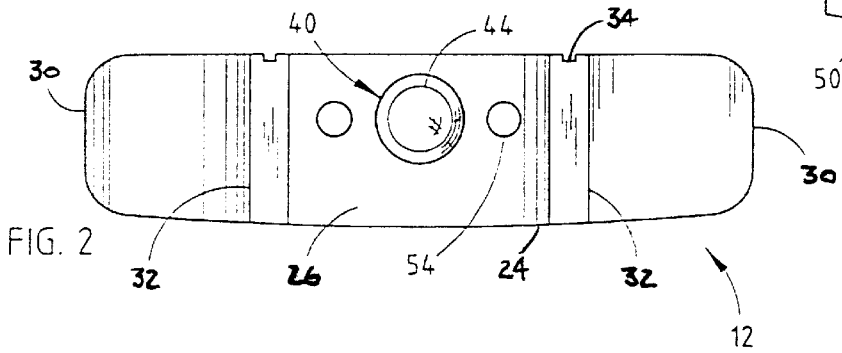
FIG. 2 is a rear elevation view of the golf club head shown in FIG. 1.
Figure 3:
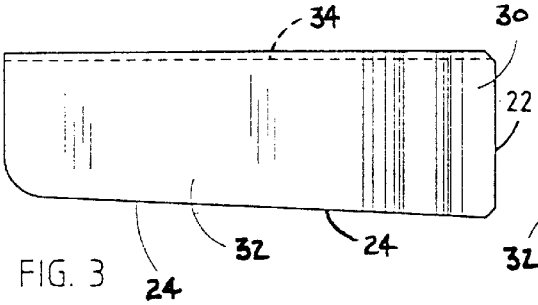
FIG. 3 is a side elevational view of the golf club head shown in FIG. 2 taken along Line II—II.
Figure 4:
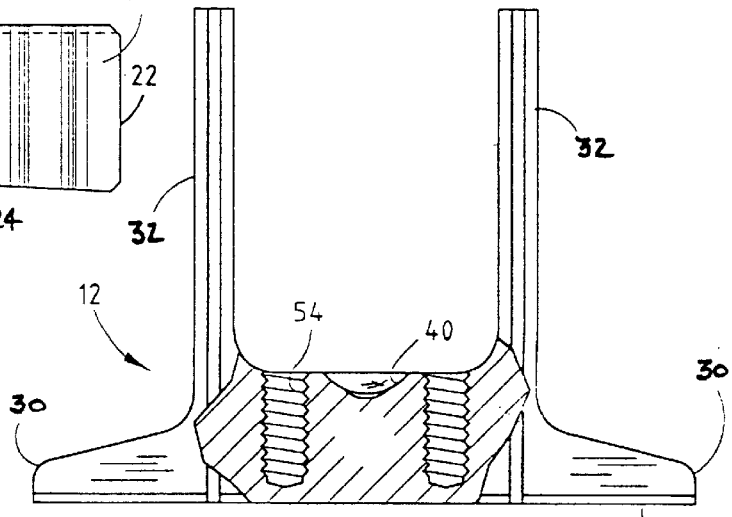
FIG. 4 is a plan view of the golf club head embodying this invention.
Figure 7:
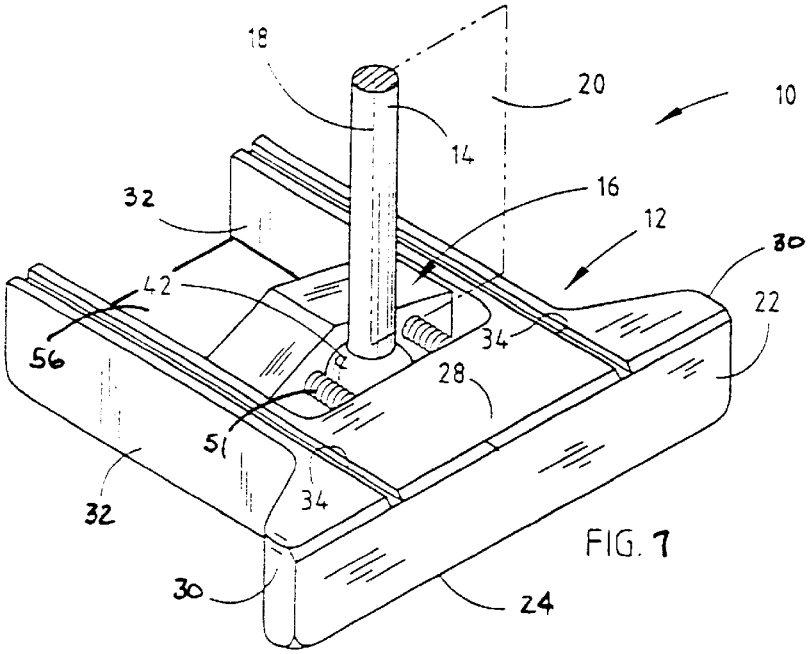
FIG. 7 is an oblique view of an alternate embodiment of the golf club.
Figure 8:
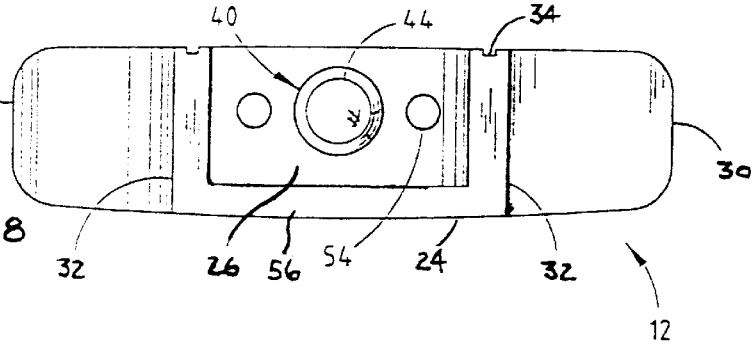
FIG. 8 is a rear elevation view of the alternate embodiment of the golf club head shown in FIG. 7.
Figure 9:
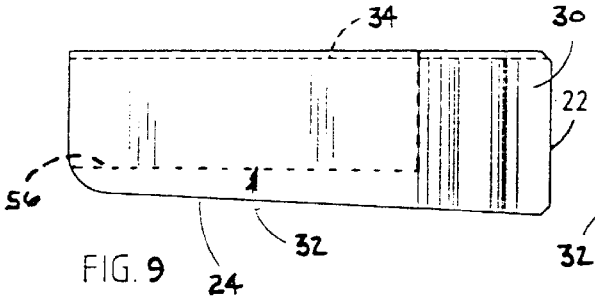
FIG. 9 is a side elevation view of the alternate embodiment of the golf club head shown in FIG. 7 taken along Line IX—IX.
Figure 10:
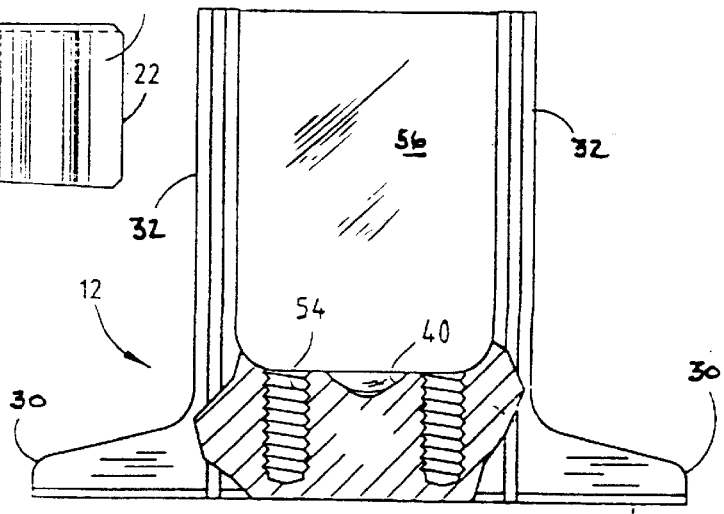
FIG. 10 is a plan view of the alternate embodiment of the golf club head.

In this particular embodiment, the golf club head or putter head 12 includes a front playing face 22 preferably having a width substantially greater than its height. The putter head 12 also includes a bottom face or sole 24, a back face 26, and a top face or surface 28. Extending generally perpendicularly from the back face 26, and spaced slightly in from the ends 30 are two spaced-apart flanges 32, which with a portion of back face 26, define a generally U-shaped structure. The upper surface 28 of the putter head 12 may also contain features which assist the golfer in using the club. For example, and not by way of limitation, FIGS. 1, 2 and 4 illustrate two parallel grooves 34 which extend perpendicular from about the front playing face 22 and extend backward along and parallel to the flanges 32. The grooves 34 aid the golfer in aligning the shot. The lower surface or sole 24 is preferably slightly radiused or rounded with the curvature becoming more prominent toward the ends of the flanges 32 and the ends 30 of the front playing face 22 to enable the club to swing freely through an arc of the stroke without catching the putting surface.

Defined in the back face 26 of the club head 12 intermediate the flanges 32 and at the bottom of the generally U-shaped portion is a depression 40. Depression is preferably semispherical or partly spherical in form having a diameter sufficient to receive a portion of the ball member 42 therein. More preferably, the depression 40 is compounded, defined by nested depressions wherein the inner depression 41 is of a lesser diameter than the outer depression 40. The inner depression 41 defines an annular spherical portion or annulus 44 which engages the ball member 42 received therein. See FIG. 2.

The ball member 42 is preferably retained within the spherical depression 40 by a keeper 46 which may also be referred to herein as a clamping member or jaw member. In the preferred embodiment, keeper 46 is made from a block of rigid material such as metal and having a dimension which substantially spans the space between the flanges 32, yet is allowed to slide therebetween in a direction to and away from the back face 26. The block forming the keeper 46 is also preferably dimensioned so as not to protrude beyond the dimensions of the club head established by the various surfaces or faces.

A front surface 48 of the keeper 46 is oriented towards the back face 26 and includes a spherical depression 50 which is preferably substantially identical in dimension and form to depression 40. Indeed, in the preferred embodiment, the depressions 40 and 50 are aligned so as to engage opposite sides of the ball member 42 and capture it between the keeper 46 and the back face 26 of the golf club head 12. The clamping pressure of the keeper 46 against the ball member 42 is preferably controlled by at least a pair of fasteners such as socket head cap screws 51 or other fasteners extending through passages 52 and received in threaded holes 54 in the back face 26 of the club 12. Although socket head cap screws are described, other fasteners may be used to provide sufficient torque to urge the keeper 46 against the ball member 42 and into the spherical depressions 40 and 50 to fix the desired position of the shaft 14 with respect to the club head 12.

It is preferred that the club head 12 be made from a metallic material such as aluminum, bronze, stainless steel, or other desired material, although it is contemplated that it may also be made from resinous material or other forms of plastics or composites. In the preferred embodiment, and in a prototype of the invention, the club head 12 and keeper 46 were manufactured from bronze, while the ball member 42 and shaft 14 were made from a stainless steel. With respect to the ball member and shaft, other materials may also be used, including graphite, carbon or related materials.

An alternate embodiment of the invention, shown in FIGS. 7 through 10, includes many of the structures described above and are identified by the same reference numbers. The alternate embodiment of the golf club head 12 includes a playing or striking face 22, a bottom face or sole 24, a back face 26, and an upper face or surface 28. Extending from the back face 26 and spaced inwardly from the ends 30 are two spaced-apart sighting flanges 32, the lower reaches of which are interconnected by a web 56. The web 56 preferably also extends to and interconnects the lower portion of the back face 26 to define a generally rectangular or box-like cavity open at one end and at the top for reasons which are apparent below. The lower surface or sole 24, including that portion defined by web 56, preferably has a slight radius or rounded sole 24 with the curvature becoming more prominent toward the ends of the flanges 32 and the ends 30 of the front playing face 22 to enable the club to swing freely through the arc of the stroke without snagging on the ground.

Defined in the back face 26 of the club head 12 intermediate the flanges 32 and above the web 56 is the compound depression 40. As in the prior embodiment, the depression is preferably semispherical or partly spherical in form having a diameter sufficient to receive a portion of the ball member 42 therein. The ball member 42 is retained in the depression 40 by the keeper 46 which, in the alternate embodiment, is made from a block of rigid material such as metal and dimensioned to slide within the generally rectangular or box-like cavity defined by the back face 26, the flanges 32, and the upper surface of the web 56. The keeper 46 slides therein in a direction to and away from the back face 26.

The front surface 48 of the keeper 46 is oriented towards the back face 26 and includes the spherical depression 50 which is aligned to engage the opposite side of the ball member 42 and capture it against the back face 26 of the golf club head 12. The clamping pressure of the keeper 46 against the ball member 42 is controlled by at least a pair of fasteners such as socket head cap screws 51 or other fasteners extending through passages 52 and received in threaded holes 54 in the back face 26 of the club 12.

The club head configuration described above may have a variety of configurations. For example, the keeper 46 may take on other forms which include the backwardly extending flanges 32 instead of them extending from the back face 26 of the club head 12. Other modifications will become apparent to one skilled in the art to make the club appear differently, but function in substantially the same way.

The advantages provided by this invention include the adjustment of the club lie with respect to the shaft as well as the adjustment of the loft or orientation of the club face vertically with respect to the shaft. Accordingly, using this design, the club may be used by left-handed and right-handed players, and be adjusted to be in either open or closed configuration to compensate for a player's swing. The concept described above may also be extended to drivers and other golf club designs by changing the overall or respective dimensions of the components mentioned herein. For example, the outer flanks of the flanges may be more rounded and blend in with the end of the club face and have a more arcuate sole to appear more like conventional drivers, while the keeper may be extended to the back of the club to make a smooth transition. Other advantages and modifications may be more readily apparent to one of ordinary skill in the art after reviewing this description.

I claim:

1. An adjustable head golf club, comprising in combination:

a golf club shaft having a spherical member disposed at a lower end;

a golf club head having a front playing face, a back face, and two spaced-apart sighting flanges extending from said back face, said back face having a spherical depression formed therein between said spaced-apart flanges and adapted to receive a portion of said spherical member therein;

a jaw member disposed between said spaced-apart flanges and translatable in a direction toward said back face, said jaw member having a spherical depression defined in a front face thereof and adapted to engage a side of said spherical member opposite said portion received by said spherical depression in said back face; and a pair of spaced-apart fasteners extending through said jaw member and into said back face for tightly clamping said spherical member between said jaw member and said back face and fixing a position of said golf club head relative to said golf club shaft.

2. The adjustable head golf club as defined in claim 1, wherein said jaw member includes a faceted body having a width about equal to a distance between said spaced-apart flanges such that said jaw member is aligned with respect to said back face by said spaced-apart flanges when said jaw member is translated toward said back face.

3. The adjustable head golf club as defined in claim 2, wherein each of said spaced-apart flanges includes a sighting groove formed in an upper surface thereof.

4. The adjustable head golf club as defined in claim 3, wherein said spherical depression formed in said front face of said jaw member includes a first depression having a first diameter, and a second depression having a second diameter nested within said first depression, said second diameter being less than said first diameter of said first depression.

5. The adjustable head golf club as defined in claim 4, wherein said first and second depressions are aligned along an axis generally parallel with a longitudinal axis of said sighting groove.

6. The adjustable head golf club as defined in claim 5, wherein said spherical depression defined in said back face includes a first depression having a first diameter, and a second depression nested within said first depression and having a second diameter, said second diameter being less than said first diameter.

7. The adjustable head golf club as defined in claim 6, wherein said first and second depressions defined in said spherical depression are aligned along an axis generally coincident with said first and second depressions formed in said jaw member.

8. The adjustable head golf club as defined in claim 7, wherein said spaced-apart fasteners extending through said jaw member include threaded fasteners.

9. A golf club, comprising in combination:

a shaft member having a spherical member at one end;

a head member having a front face, a back face, a lower surface, and two spaced-apart flanges extending from said back face, and a compound recess defined on said back face intermediate said two spaced-apart flanges and adapted to partially receive said spherical member therein;

a keeper disposed between said two spaced-apart flanges in sliding relationship with respect to said head member and said two spaced-apart flanges, said keeper having a compound depression formed therein on a face oriented toward said back face and adapted to partially receive an opposite side of said spherical member therein; and a plurality of spaced-apart fastening members extending through said keeper and into said back face of said head member for urging said keeper tightly against said spherical member such that said head member is fixed with respect to said shaft in a predetermined orientation.

10. The golf club as defined in claim 9, wherein said shaft includes said spherical member disposed at a lower end of said shaft.

11. The golf club as defined in claim 10, wherein said compound recess defined in said back face includes a first depression adapted to receive a portion of said spherical member therein, and a second depression nested within said first depression wherein said second depression is smaller than said first depression.

12. The golf club as defined in claim 11, wherein said two spaced-apart flanges extending from said back face define generally parallel sighting lines.

13. The golf club as defined in claim 12, wherein said two spaced-apart flanges and said back face define a generally U-shaped structure.

14. The golf club as defined in claim 13, wherein said two spaced-apart flanges extending from said back face are interconnected by an intermediate web.

15. The golf club as defined in claim 14, wherein said two spaced-apart flanges extending from said back face are approximately perpendicular with respect to said front face.

16. The golf club as defined in claim 15, wherein said keeper includes a block dimensioned to slide closely between said two spaced-apart flanges and substantially fill the space therebetween.

17. The golf club as defined in claim 16, where said keeper includes a lower surface which does not extend below said lower surface of said head member.

18. A golf club comprising:

a golf club shaft having a ball member attached to one end;

a golf club head having a playing face and a back face, said back face having a depression defined therein and configured to partially receive a portion of said ball member;

a clamping block assembly detachably connected to said back face of said head by a plurality of spaced-apart fasteners and moveable toward said back face of said golf club head, said clamping block including a clamping face oriented toward said back face and having a depression defined therein configured to partially receive and clamp against an opposite portion of said ball member therein, fixing a relative position of said golf club head in a predetermined pitch and lie with respect to said golf club shaft.

* * * * *